US005354181A

United States Patent [19]

Porel

[11] Patent Number: 5,354,181

[45] Date of Patent: Oct. 11, 1994

[54] HYDRAULIC PISTON PUMPS EQUIPPED WITH SUCTION VALVE

[75] Inventor: Louis-Claude Porel, Rambervillers, France

[73] Assignee: Hydro Rene Leduc, Azerailles, France

[21] Appl. No.: 23,951

[22] Filed: Feb. 26, 1993

[30] Foreign Application Priority Data

Feb. 28, 1992 [FR] France ..... 92 02334
Jun. 5, 1992 [FR] France ..... 92 06827

[51] Int. Cl.[5] ..... F04B 1/12

[52] U.S. Cl. ..... 417/269; 417/545; 417/284; 91/499

[58] Field of Search ..... 417/269, 545, 284, 511; 91/499–502

[56] References Cited

U.S. PATENT DOCUMENTS

| | | | |
|---|---|---|---|
| 2,389,374 | 11/1945 | Levy | 417/511 |
| 2,431,686 | 12/1947 | Deschamps | 417/269 |
| 2,821,932 | 2/1958 | Lucien | 417/269 |
| 2,945,444 | 7/1960 | Leissner | 417/269 |
| 2,980,077 | 4/1961 | Magill | 91/499 |
| 3,303,749 | 2/1967 | Ocule | 91/499 |
| 3,498,227 | 3/1970 | Kita | 417/269 |
| 3,514,223 | 5/1970 | Hare | 417/499 |
| 3,609,970 | 10/1971 | Benson | 417/284 |
| 4,637,293 | 1/1987 | Yamaguchi et al. | 91/499 |
| 5,114,261 | 5/1992 | Sugimoto et al. | 417/269 |

FOREIGN PATENT DOCUMENTS

| | | | |
|---|---|---|---|
| 0234006 | 9/1987 | European Pat. Off. . | |
| 1039843 | 9/1958 | Fed. Rep. of Germany . | |
| 2622756 | 5/1975 | Fed. Rep. of Germany . | |
| 1199497 | 12/1959 | France | 91/499 |
| 2386699 | 4/1977 | France | 91/499 |
| 2352172 | 5/1977 | France . | |
| 2657128 | 7/1991 | France | 417/269 |
| 257522 | 11/1945 | Switzerland . | |

*Primary Examiner*—Richard A. Bertsch
*Assistant Examiner*—Peter Korytnyk
*Attorney, Agent, or Firm*—Darby & Darby

[57] ABSTRACT

Hydraulic piston pump driven in an alternating reciprocating motion by bearing, through a stud, against a cam carried by a drive shaft, characterized by the fact that a device acting as non-return feed valve is incorporated in each piston (14) while the discharge pressure is permanently re-injected into the interior of the stud (17) by which said stud (17) takes support on said cam (6).

26 Claims, 6 Drawing Sheets

P
T
M
F1
F2
r1
2
1
3
4
5
6
6a
7
8
9
10
11
12
13
14
15
16
17
17'
18
19
20
21
22
23
24
25
26
27
28
29
30

14b
14c
14a

12
P
13
15
9
14
M
14b
8
T
6
r
36
16
19
F1
14c
14a
21
F2
11
10
9
2
31
17b
6a
17a
32
6
20
7
1
5
4
3

40
12
10
41
13
P
9
42
M
39
14
43
37
8
T
19
17
29
22
9
8
10
39
11
10
42
39
38
39
2
22
6a
6
7
21
20
5
1
4
3

39
14
43

43
39
14
42

42
14
43
42

P
T
M
F1
F2
x
y

HYDRAULIC PISTON PUMPS EQUIPPED WITH SUCTION VALVE

BACKGROUND OF THE INVENTION

The present invention relates to hydraulic piston pumps in which the pistons are driven in a reciprocating motion by bearing on a cam, said cam being of any appropriate form, in particular, but not limited thereto, the form of a skew plate.

In this type of pump the pistons may be "axial", that is, parallel to the axis of the pump, or "radial", that is, perpendicular to the axis of the pump and arranged along radii. In a general manner, radial pistons take support on one or more cams, carried by the drive shaft, while axial pistons are supported an on a skew plate, sometimes called oscillating plate.

It is known practice to arrange a suction valve on each piston, and to arrange a discharge valve downstream of each bore in which a piston moves. Thus, when the piston is extracted from its bore, the hydraulic liquid is admitted into said bore through said piston by a non-return valve integrated in the piston, and when the piston is driven into its bore, the liquid is forced out of it.

DESCRIPTION OF THE PRIOR ART

Such pumps are described in Swiss Patent No. 257,522 (MESSIER) or U.S. Pat. No. 2,389,374 (LEVY) or European patent 0,234,006 (ALLIED CORPORATION).

The serious drawback of pumps of this kind is that the entire discharge pressure is applied on the mechanical means which impart their reciprocating motion to the pistons. As the trend is to employ pumps of low rates of flow but high pressure, the means by which the piston heads take support on the skew plate are subjected to stresses such that the piston heads slide poorly on the skew plate and wear it quickly. An attempt has been made to eliminate this disadvantage by arranging, for example, a crown-shaped ball thrust bearing between the skew plate and the piston heads (Swiss patent MESSIER, FIG. 1); or by arranging a ball between each piston head and the skew plate (U.S. Patent to LEVY). However, these means are insufficient and gripping still occurs and these pumps cannot be used for high pressures.

In German patent 1,039,843 (SIAM), a device is described permitting to obtain a hydrostatic balancing of the means by which the piston heads rest against the skew plate. To this end, support studs pierced in their center have been interposed between the face of the skew plate and the piston heads, piercing also the pistons. As a result, the discharge pressure is reinjected across the body and the head of the pistons and then across the support stud against the face of the skew plate, and by suitably choosing the surface of the central opening of the support stud one can obtain a hydrostatic balancing of the stud and sliding without difficulty on the face of said skew plate.

But this arrangement does not allow placing a suction valve inside the piston. Therefore, for many years special devices has been provided for introducing the fluid into the cylinders during the suction stage. Also the position of such special devices must be inverted when the drive of the pump changes direction.

In pumps manufactured by the assignee of Applicant, each piston is hollow and rests against the face of the skew plate through a sliding stud which is traversed from side to side by a seating which receives the piston head and by an orifice communicating with this seating. The admission of the liquid into the piston, during the suction stage, occurs when the stud circulates above a groove, or lunule, engraved on the face of the piston. As long as the seating straddles said lunule, the hydraulic liquid present in the admission chamber in which the skew plate moves passes through the lunule, traverses the stud and then the hollow piston, and arrives in the bore in which said piston moves. During the delivery stage, the stud slides over a portion of the face of the skew plate, which is smooth and no longer has a lunule; the communication with the feed chamber is cut off and the liquid is pressed back. This arrangement has the effect that the liquid present inside the stud is always under a pressure equal to the discharge pressure, and therefore, by calculating the width of the crown of said stud in contact with the face of the plate as a function of the cross-section of the head of the piston resting on said stud, a hydrostatic balancing of the stud can be obtained such that the latter slides permanently on an oil film.

The wear resistance of such pumps is high, but having to make the suction through a lunule and a stud greatly limits the pumps performance not only with respect to its output, but also because of the fact that they can work only in one direction.

As to the output, if a large piston displacement of the pump is desired, more pistons must be provided, which is very expensive. But a limitation in speed of rotation is inevitable because the path which the oil must travel to get to the interior of the piston is so long that above a certain speed of rotation the liquid can no longer circulate fast enough and the pump goes into cavitation.

As to the fact that this type of pump can operate in one direction only, the Applicant's assignee has proposed in its French Patent No. 2,394,692 means for inverting the direction of operation of these pumps, but such inversion is made by manual intervention, making the use of such pumps complicated.

OBJECT OF THE INVENTION

The object of the present invention is a hydraulic piston pump in which the suction occurs through a valve incorporated in each piston while realizing hydrostatic balancing of the stud by the agency of which each piston takes support on the cam which sets it in motion.

BRIEF DESCRIPTION OF THE INVENTION

In one embodiment, the device acting as the suction valve is located at the level of the connection between said stud and the piston head. In another embodiment the device acting as a valve is opposite the piston head. But in all cases there is re-injection of the discharge pressure into the stud.

This arrangement offers several advantages.

The first is that the circulation of the fluid in the suction stage is simplified so that the pump is no longer limited with regard to its speed of rotation.

The second is that such a pump can operate indiscriminately in either direction.

The third is that it is not necessary to provide special means for inverting the direction of operation of the pump.

The fourth is that the feed is improved so while preserving the advantage of hydrostatic balancing that the number of pistons can be reduced while keeping the same displacement, thereby considerably lowering the cost of the pump.

BRIEF DESCRIPTION OF THE DRAWINGS

By way of non-limiting examples and for better understanding of the invention, the annexed drawings show.

DESCRIPTION OF THE PREFERRED EMBODIMENTS

Figures 1, 2:
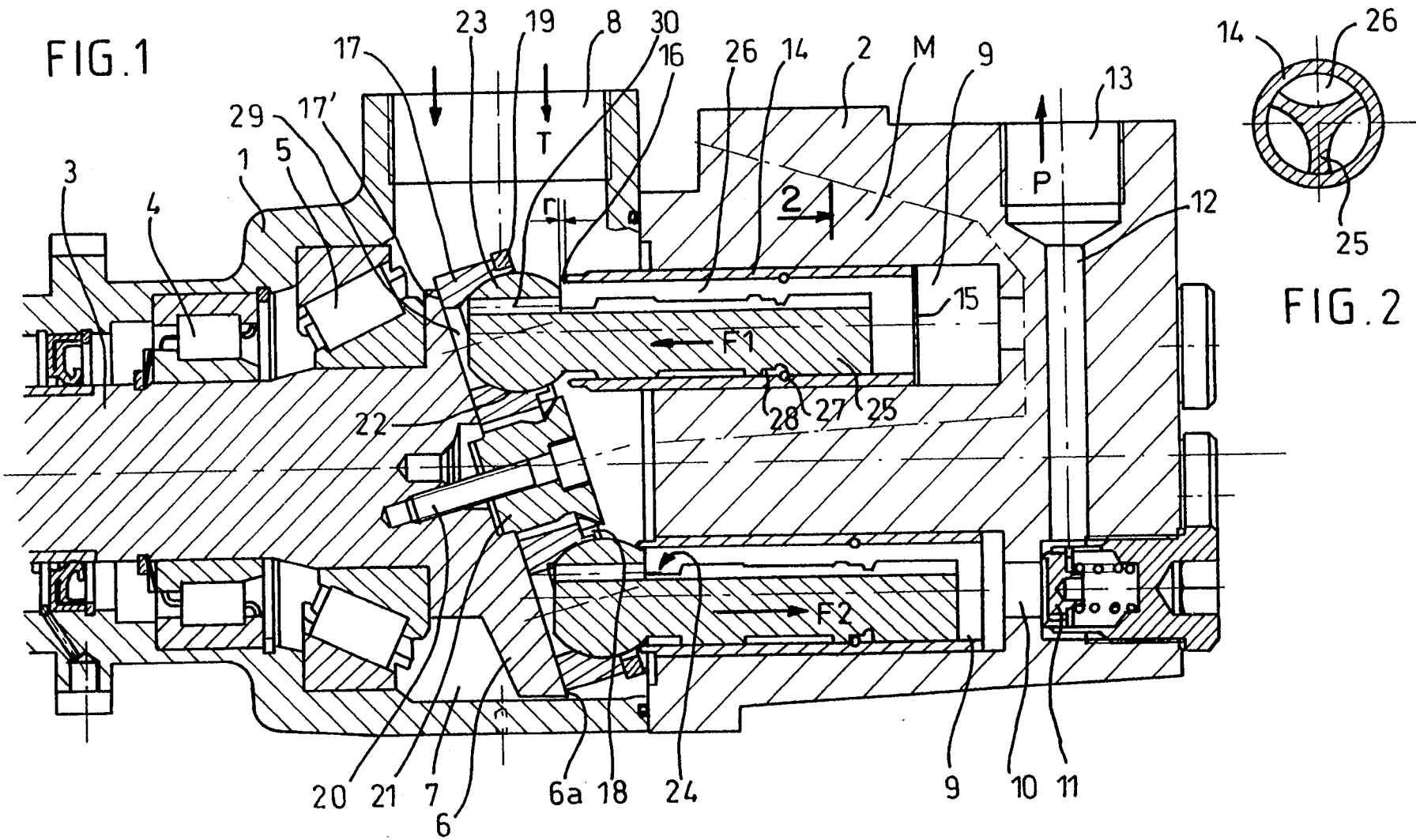
FIG. 1, a view in longitudinal section of a first embodiment of the invention.
FIG. 2, a view in transverse section along A—A of FIG. 1.

All of the figures of the drawings represent axial piston pumps which are driven in an alternating reciprocating motion according to the arrows $F_1$ and $F_2$ by a skew plate.

In all these pumps there is an odd number of pistons, so that in FIGS. 1, 3, 5, 7 and 11 it is shown in section only the piston of the bottom of the figure; however, for better illustration of the invention, the section of the piston of the top of the figure has been shifted as illustrated by the broken line which delimits the zone M.

Each of these pumps has two parts 1 and 2, part 1 carrying the drive shaft 3 by means of rolling bearings 4 and 5, said shaft 3 carrying the skew plate 6, which moves in the feed chamber 7 connected to the feed orifice 8. Part 2 comprises a plurality of cylindrical bores 9, parallel to the axis of shaft 3 and disposed all around. Each bore 9 has at its bottom a channel 10 which, through a non-return discharge valve 11, communicates with a channel 12 which opens into the outlet orifice 13. In each bore 9 there is a piston 14 which rests against the oblique face 6*a* of the skew plate 6 by means of a sliding pad called a stud 17. Each piston 14 is connected in traction with its stud 17, which is kept in sliding contact against the face 6*a* of skew plate 6 by a retention plate 19, fastened to plate 6 by a bolt 21 with a shim 18 to avoid any blocking of the studs by the retention plate 19.

In the embodiment of FIGS. 1 and 2, piston 14 is hollow and associated with an insert 24, of triangular cross-section (FIG. 2) which can slide inside said piston 14. Piston 14, which is a hollow cylinder open at both ends 15 and 16, has a circlip 27 which can move in a circular groove 28 cut in the body of the insert 24. The portion of the insert 24 that slides in the piston 14 has several ribs forming grooves 26 (three in the example shown).

Insert 24 has a spherical head 23, disposed in a spherical seating 22 provided in a stud 17. In a known manner, the spherical head 23 has a circular flattening arranged at the level of a circle perpendicular to the axis of the insert 24, so that it is possible to cause the spherical head 23 to penetrate into its seating 22 when the axes of the head and of the seating coincide and it is not possible to make it come out when these axes do not coincide any more. Thus, the insert 24 is integral under traction with stud 17.

When an insert 24 moves in the direction of arrow $F_1$, said insert slides inside the hollow piston 14 until the circlip 27 abuts against the bottom of groove 28 and, from that moment on, the piston 14, too, is taken along in the direction of arrow $F_1$. The relative movement of insert 24 and piston 14 has freed the spherical head 23 from its support on the edge of the orifice 16 of piston 14, thereby permitting the hydraulic liquid present in chamber 7 to flow into the interior of piston 14, to traverse it, and to get through the outlet end 15 of piston 14 into the bore 9. When insert 24 moves in the direction of arrow $F_2$, the insert slides inside piston 14 until the spherical head 23 bears against the edge of the inlet end 16 of the piston, thereby closing this orifice and making the insert and the piston integral in thrust. The piston then also moves in the direction of arrow $F_2$ and, orifice 16 being closed, the liquid present in bore 9 is discharged through the channel 10 through the non-return discharge valve 11.

As is seen in FIG. 1, head 23 of insert 24 is traversed from end to end by a bore 30 which, on one side, opens into one of the three grooves 26 of insert 24 and on the other side into a bore 29 traversing stud 17 to the seating 22.

As a result, the pressure prevailing in bore 9 is permanently reinjected into the orifice 29. It then suffices, as is known, to calculate the thickness of the circular edge 17' of stud 17 as a function of the cross-section of piston 14 and of the support zone of the spherical head 23 in its seating 22 to obtain hydrostatic balancing of the stud 17 so as to permanently maintain a thin film of oil between the face 6*a* of the skew plate and the edges 17*a* of the studs 17.

Thus a skew plate pump is obtained in which the suction valves are incorporated in the pistons, a suction lunule engraved on the skew plate, but in which the support studs of the pistons are hydro-statically balanced.

Figures 3, 4:
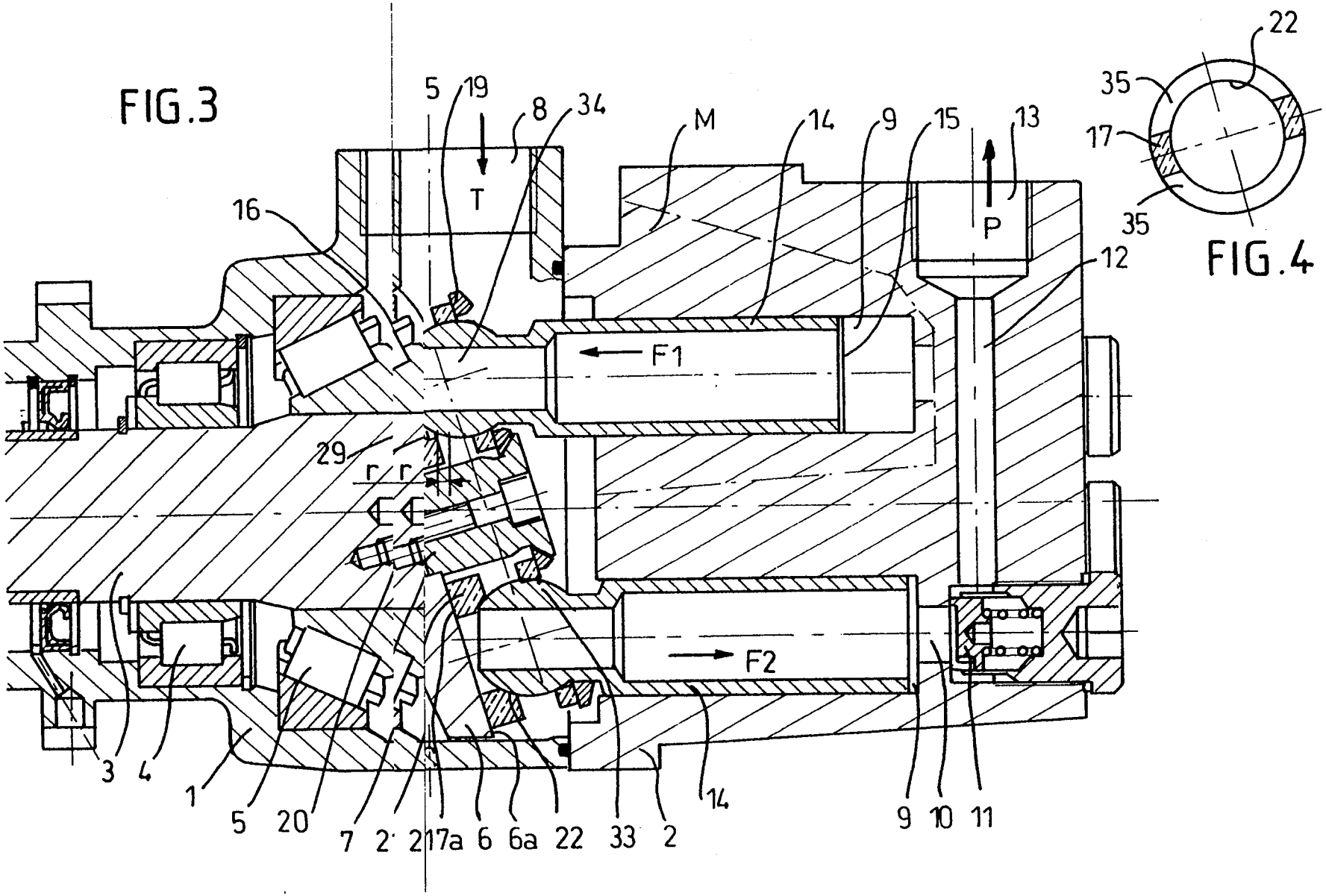
FIG. 3, a view in longitudinal section of a second embodiment of the invention.
FIG. 4, a view in transverse section along A—A of FIG. 3.

FIGS. 3 and 4 represent a second embodiment of the invention in which the same elements bear the same references.

In this embodiment there is no longer an insert 24, and the piston 14 has a spherical head 33 which rests in the spherical seating 22 of stud 17. But the respective dimensions of said spherical seating 22 and of the spherical head 33 of piston 14 are calculated so that said head 33 can move in its seating 22, but without being able to come out of it.

Stud 17 has on the other hand lateral passages 35 which cause the seating 22 to communicate with chamber 7. Head 33 of piston 14 is traversed from end to end by a central bore 34 which communicates with the central bore of piston 14, which is hollow. When stud 17 moves in the direction of arrow $F_1$, head 33 of piston 14 moves in its seating 22, with the effect of causing said seating 27 to communicate with chamber 7 through the passages 35; the liquid present in said chamber 7 then passes into bore 9 through the passages 35, seating 22, passage 34 of head 33 and the interior of piston 14. When stud 17 moves in the other direction, $F_2$, head 33 of the piston comes to bear against the bottom of its seating 22, thereby closing the communication between the passages 35 and said seating 22. The liquid present in passage 34, in the interior of piston 14, and in bore 35 cannot flow back into chamber 7 and is discharged across the non-return valve 11.

As in the preceding example, the central passage 29 of stud 17 is filled with liquid permanently present at the same pressure as the discharge pressure, thereby permitting to obtain hydrostatic balancing of each stud 17.

Figures 5, 6:
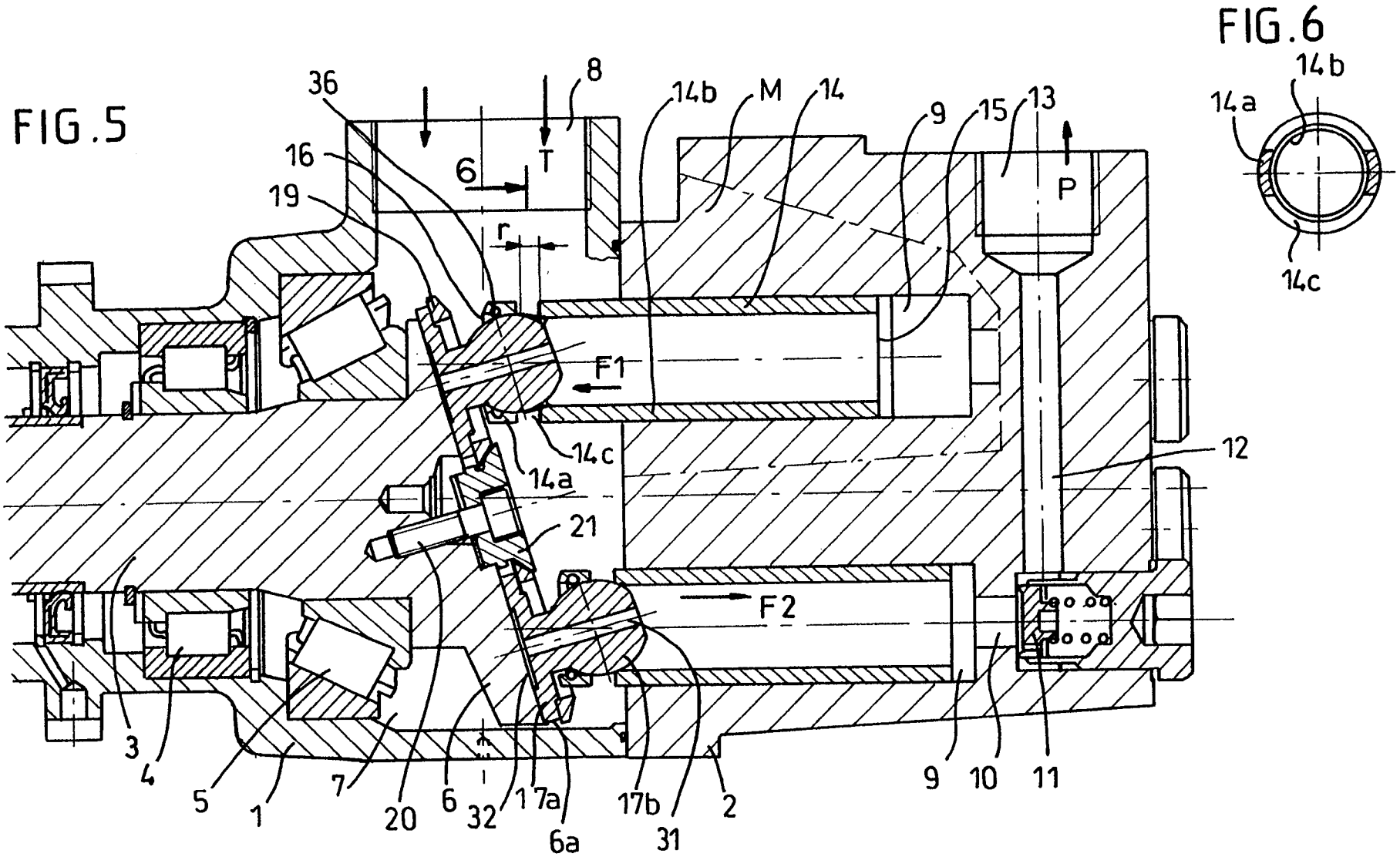
FIG. 5, a view in longitudinal section of a third embodiment of the invention.
FIG. 6, a view in transverse section along A—A of FIG. 5.
Figures 7, 8, 9, 10:
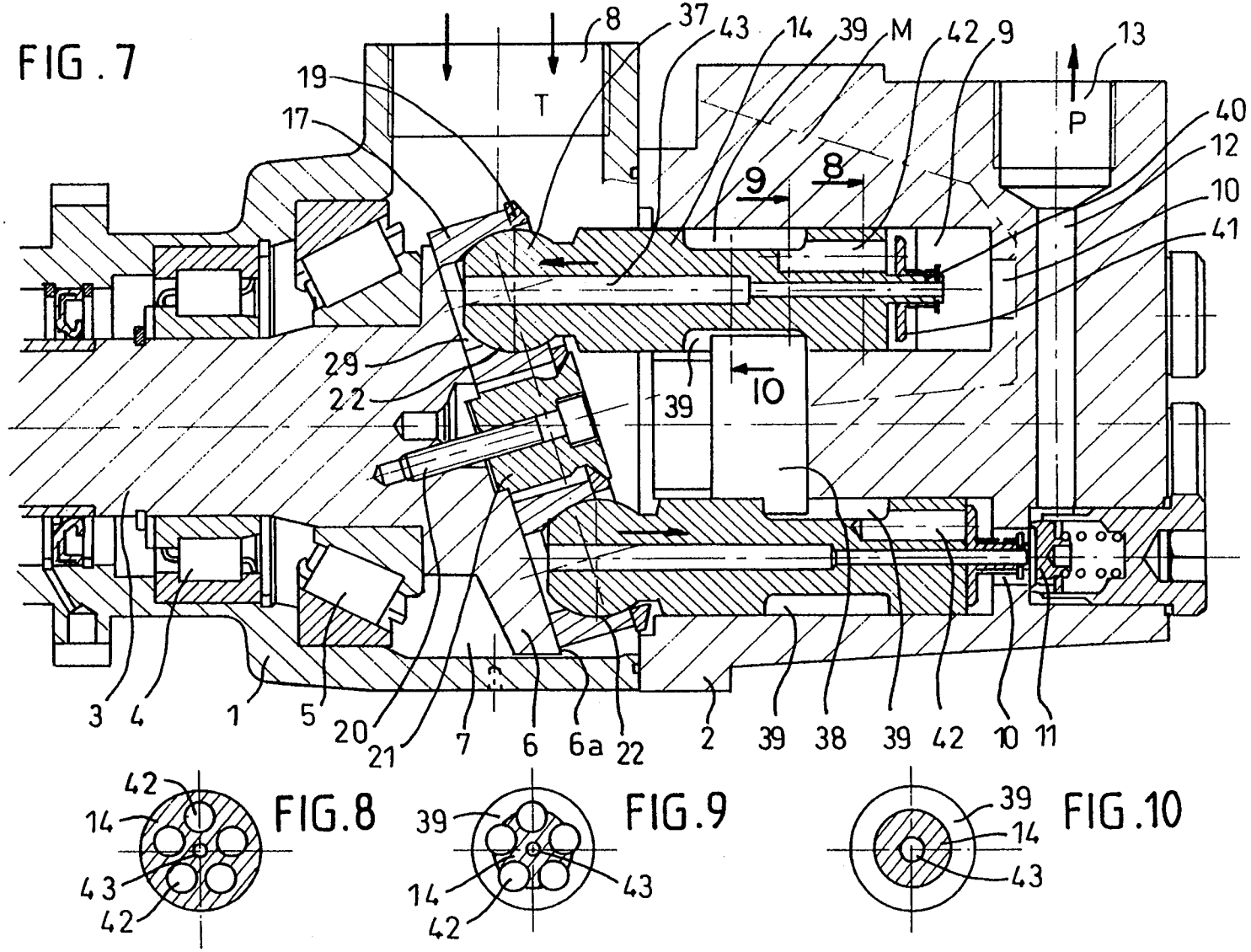
FIG. 7, a view in longitudinal section of a fourth embodiment of the invention.
FIG. 8, a view in transverse section along A—A of FIG. 7.
FIG. 9, a view in transverse section along B—B of FIG. 7.
FIG. 10, a view in transverse section along C—C of FIG. 7.
Figures 11, 12, 13, 14, 15:
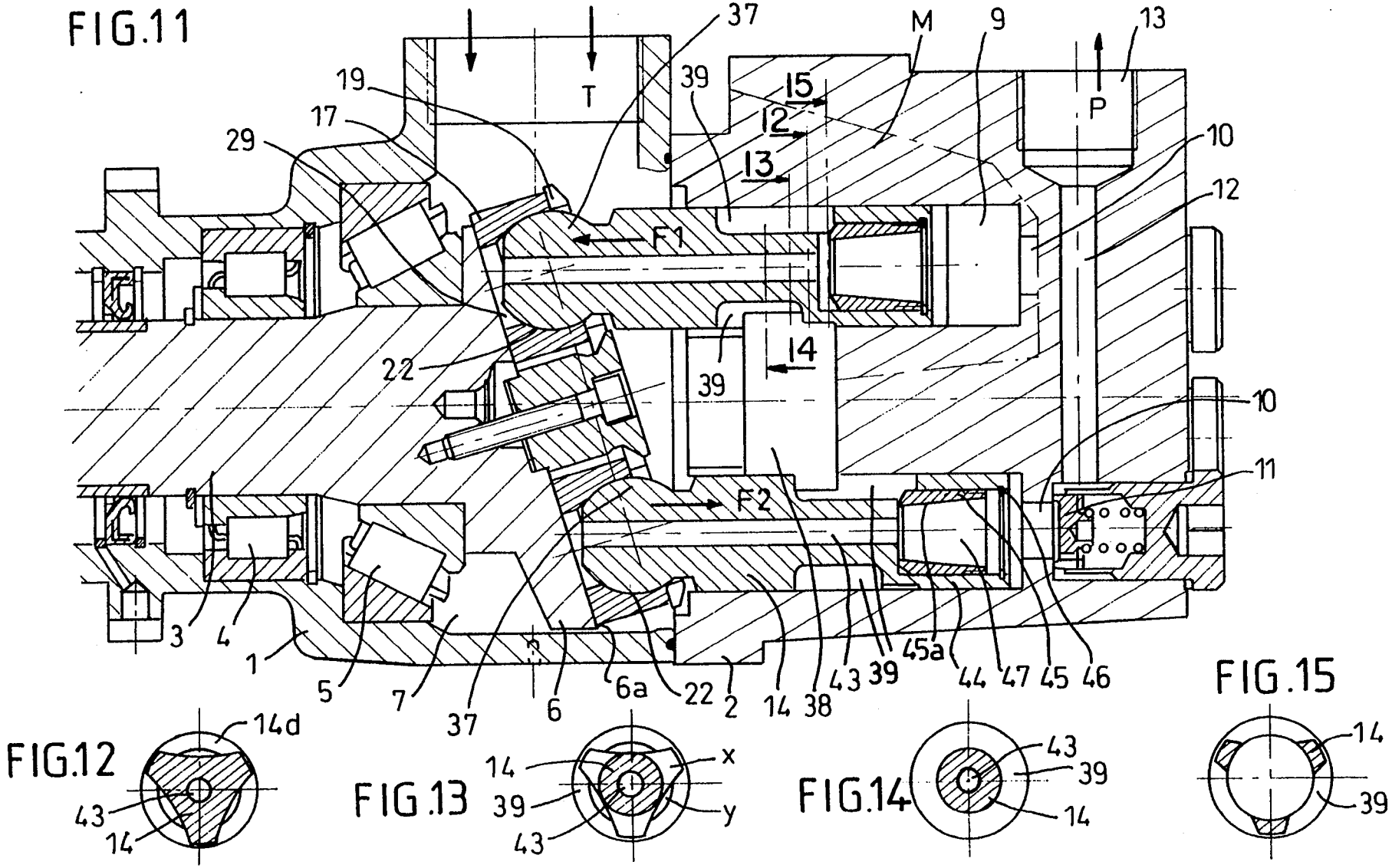
FIG. 11, a view in longitudinal section of a fifth embodiment of the invention.
FIG. 12, a view in transverse section along A—A of FIG. 11.
FIG. 13, a view in transverse section along B—B of FIG. 11.
FIG. 14, a view in transverse section along C—C of FIG. 11.
FIG. 15, a view in transverse section along D—D of FIG. 11.

In the embodiment according to FIGS. 5 and 6, each stud 17 is in two parts: a flat pedestal **17*a* which rests against the face 6*a* of skew plate 6 and a spherical head 17*b* which engages in the interior of piston 14, which is a hollow cylinder open at both ends 15 and 16. The part 14*a* of piston 14 which is located on the side of the orifice 16 has an inside diameter slightly greater than that of the rest 14*b* of the piston, thereby enabling the spherical part 17*b* of stud 17 to penetrate into this part 14*a* until it abuts against the edge of part 14*b*. A circlip 36 placed in part 14*a* of piston 14 prevents said spherical part 17*b* from coming out of the piston, but this circlip 36 is placed so that said part 17*b* can move between the position where it bears against this circlip 36 and the position where it bears against the edge of part 14*b* of the piston. Part 14*a* is provided with passages 14*c* which end at the level of the edge of part 14*b***.

When stud 17 moves in the direction of arrow $F_1$, its part **17*b* moves relative to piston 14 until it abuts against circlip 36, thereby making piston 14 integral with said pad under traction. This relative displacement of stud 17 with respect to piston 14 permits the passages 14*c* to communicate with the interior of part 14*b* of piston 14 and hence permits the liquid present in chamber 7 to get to bore 9. On the other hand, when stud 17 moves in the direction $F_2$, the spherical part 17*b* of said stud moves in part 14*a* of piston 14 until it bears against the edge of part 14*b*, thereby interrupting all communication between the passages 14*c* and the interior of part 14*b* of said piston 14. The liquid present in bore 9 can no longer flow back into chamber 7 and is discharged through the non-return valve 11**.

Stud 17 is traversed from end to end by a passage 31 which opens into a circular chamber 32 arranged at the base of said stud in the pedestal-forming part **17*a*. This chamber 32 is open on the face 6*a* of plate 6. As a result, this chamber 32 is permanently at the discharge pressure, thereby permitting hydrostatic balancing of the studs 17**.

In the embodiment according to FIGS. 7 to 10 and that in FIGS. 11 to 15, the studs 17 are identical with those of FIG. 1 and each piston 14 is equipped with a spherical head 37 placed in the spherical seating 22 of stud 17 like the spherical head 23 of the insert 24 so as to be made integral under traction with this stud. Each piston 14 is full and has at its end opposite its spherical head 37 a non-return valve.

In these two embodiments, the feed occurs through a non-return valve situated behind the piston, this valve being brought into communication with an annular chamber 39 arranged on piston 14 at about mid-length, which communicates with a central feed chamber 38 arranged in the pump body 2 and opening into chamber 7.

In the embodiment of FIGS. 7 to 10, the piston, which is solid, has on its rear face a cylindrical extension 40 which constitutes a guiding rod for a valve 41, the circular plate of which closes a plurality of parallel passages 42 which bring bore 9 and the annular chamber 39 into communication.

A passage 43 traverses piston 14 from end to end so as to bring bore 9 and the central orifice 29 of stud 17 into communication, which permits obtaining hydrostatic balancing of said stud.

In the embodiment of FIGS. 11 to 15, the solid piston 14 has at its rear part a cage 44 in which moves a cylindrical ring 45, the inner wall **45*a* of which is conical. This ring 45 moves between a position in which it bears against the body of piston 14 and a second position in which it is retained by a circlip or the like 46. When this ring 45 bears against circlip 46, it permits communication between extensions of the circular chamber 39 and the space 47 inside cage 44, which space 47 communicates with bore 9; on the other hand, when it bears against circlip 46, the communication between chamber 39 and space 47 is interrupted. As a result, when piston 14 moves according to $F_1$, the liquid present in chamber 38 (which in a way is a prolongation of chamber 7) passes through the annular chamber 39 and then through space 47 and bore 9; on the other hand, when piston 14 moves according to $F_2$, the liquid present in space 47 and in bore 9 cannot flow back into the annular chamber 39 and is discharged through channel 10 across the non-return valve 11**.

Piston 14 is traversed from end to end by a passage 43 which discharges on the one hand into the central orifice 39 of stud 17 and on the other hand into space 47 so that this central orifice 39 is in communication with the discharge pressure prevailing in bore 9, which permits hydrostatic balancing of stud 17.

Figure 16:
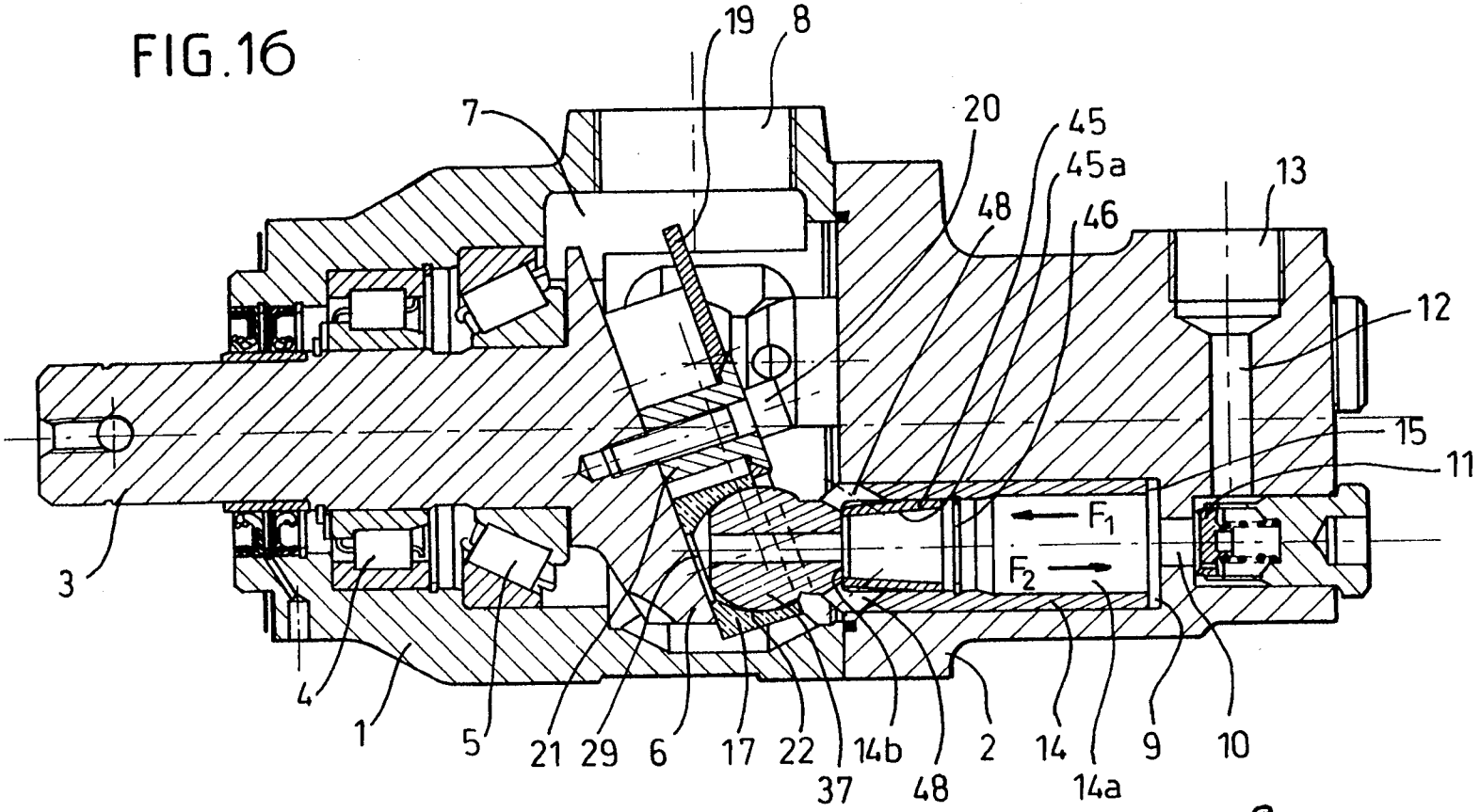
FIG. 16, a view in longitudinal section of a fifth form of realization of the invention.
Figure 17:
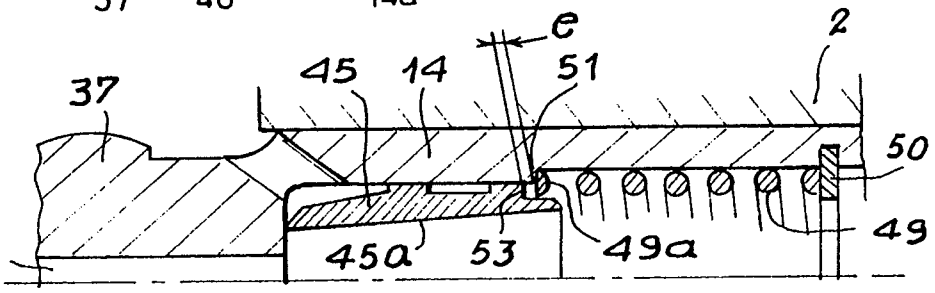
FIG. 17, a large scale view of a detail of FIG. 16 comprising a variant of realization.

As in the preceding embodiments, the hydraulic pump shown in FIGS. 16 and 17 has parts 1 and 2, part 1 carrying the drive shaft 3 by means of rolling bearings 4 and 5, said shaft 3 carrying the skew plate 6, which moves in the feed chamber 7 communication with the feed orifice 8. Part 2 includes a plurality of cylindrical bores 9, parallel to the axis of shaft 3 and arranged all around; each bore 9 having at its bottom a channel 10 which, across a non-return discharge valve 11, communicates with a channel 12 which opens into the outlet orifice 13. In each bore 9 is placed a piston 14 which bears against the oblique face **6*a* of skew plate 6 by means of a sliding stud 17. Each piston 14 is connected in traction with its stud 17, which is kept in sliding contact against the face 6*a* of skew plate 6 by a retention plate 19, fastened to plate 6 by a bolt 21 with a shim 18 to avoid any blocking of the studs by the retention plate 19**.

Each piston 14 has a spherical head 37, which rests in a seating 22 arranged in stud 17.

In a manner similar to what has been described before, the spherical head 37 has a circular flattening arranged at the level of a great circle perpendicular to the piston axis, so that it is possible to cause the spherical head 37 to protrude into its seating 22 when the axes of the head and of the seating coincide and that it is no longer possible to make it come out when these axes do not coincide. Thus the head 37 of piston 14 is integral under traction with stud 17.

Piston 14 is a hollow piston provided with a spherical head 37 which is traversed from end to end by a channel 43. This channel 43 opens on the one hand into bore 14*a* of piston 14 and on the other hand into the hollow cavity situated inside stud 17 and formed by the spherical seating 22 and the passage 29.

At the end of the inner bore 14*a* which is situated on the opposite side of its end 15, a cylindrical ring 45 is provided whose inner wall 45*a* is conical. This ring 45 moves between a position in which it bears against the bottom of bore 14*a*, where channel 43 discharges, and a second position in which it is held by a circlip 46.

The hollow piston 14 has at its end opposite its end 15, that is, near its spherical head 37, a plurality of passages 48, which discharge into the part 47 of bore 14*a* of said piston 14 in which the ring 45 can move.

When ring 45 bears against circlip 46, it permits communication between feed chamber 7 and bore 14*a*; when this ring bears against the bottom 14*b* of said bore 14*a*, it closes the passages 48.

It is seen, therefore, that in the suction stage (movement according to $F_1$) the hydraulic liquid present in chamber 7 penetrates into the interior of the hollow piston 14 and that in the discharge stage (movement according to $F_2$) the hydraulic liquid being no longer able to return into chamber 7 is discharged through drilling 10 across the discharge valve 11, channel 12 and outlet orifice 13.

FIG. 17 is a partial view on a larger scale of the piston 14, its head 37 and the suction valve 45.

According to this embodiment, the suction ring 45 is no longer free to move between the (closed) position where it rests against the bottom 14*b* of bore 14*a* of piston 14 and an (open) position where it rests against the circlip 46; but it is retained by a spring 49 toward the closed position. However, the spring 49 does not hold the ring 45 bearing against the bottom 14*b* of bore 14*a*. In fact, spring 49 is disposed between a stop 50 and a shoulder 51 arranged inside bore 14*a*, whose width is equal to about one half of the last spiral 49*a* of spring 49. The ring 45 has a shoulder 53 also having a width equal to about one half the width of the last spiral 49*a*. When the suction valve opens, that is, when ring 45 moves to the right in FIG. 17, the shoulder 53 comes in contact with the spiral 49*a* and the spring is compressed. In the reverse direction, spring 49 pushes ring 45 until it bears against shoulder 51. As is represented in FIG. 17, when ring 45 rests against the bottom 14*b* of bore 14, there is an offset "e" between the shoulders 51 and 53, the distance "e" being between 0.10 and 0.15 millimeters. As a result, ring 45 can move freely over this distance without being influenced by spring 49.

This arrangement allows easy starting of the pump, when it must pump air before being started.

All pumps thus described show the double characteristic of having a very efficient device for supplying the bores 9 with oil in the sense that even at great speed there is no phenomenon of cavitation and that the open passages for the circulation of the liquid toward the bores 9 are very large, while yet permitting to have hydrostatic balancing of the studs bearing against the face of the skew plate. As a result, there is added to the previously mentioned advantages the fact that one can reduce the number of pistons while increasing their diameter to get the same displacement, thereby permitting to significantly lower the cost of production, which is an essential advantage for a product intended to be manufactured in quantity. One can have, for example, pumps with only three pistons while yet having a large displacement and a speed of rotation of 2,000 t/min and more.

In the foregoing, the examples described relate to axial piston pumps taking support on a skew plate, but the arrangements described are transferrable directly, without the least effort of adaptation, to radial piston pumps taking support on a cam carried by the drive shaft.

What is claimed is:

1. A hydraulic piston pump comprising:

a housing having a fluid entrance and a fluid exit, a skew plate rotated by a drive shaft within said housing, a plurality of pistons each having an inlet and an outlet, a respective stud adjacent the inlet of each piston having a face supported on said skew plate for rotating each said piston with a reciprocating motion to provide communication of each piston inlet with the housing fluid entrance and each piston outlet with the housing fluid exit with the fluid being compressed by a piston as it is moved from a fluid intake to a fluid discharge position to the housing fluid outlet, said stud having an opening to the face of said skew plate, and non-return feed valve means for each piston including means for feeding the compressed fluid at the pump fluid exit back to the stud of the piston and through the stud opening to the skew plate to balance the hydrostatic pressure.

2. Hydraulic pump according to claim 1, wherein the non-return feed valve means is disposed at the end of the piston cooperating with its stud.

3. Hydraulic pump according to claim 1, wherein the non-return feed valve means is disposed at the end of the piston opposite to that which cooperates with its stud.

4. A hydraulic pump, as in claim 1, wherein said non-return feed valve opens the piston inlet to receive fluid from the pump fluid entrance and closes the inlet at the time the piston is at the pump fluid exit.

5. A hydraulic pump comprising:

a piston driven in reciprocating motion between respective positions for fluid intake at one pressure and a fluid discharge at a higher pressure by a support stud riding against a skew plate rotated by a drive shaft, a non-return feed valve means at the end of the piston cooperating with the piston's support stud for supplying intake fluid to said piston and for reinjecting fluid at the discharge pressure to the interior of said stud, which comprises;

said piston being hollow and open at each of its ends, an insert having a part which slides inside the piston and as another part a spherical head disposed in a spherical seating formed in its stud, the piston and the insert being movable relative to each other between a first position in which the spherical head of the insert closes the fluid intake end of the hollow piston by engaging against the piston and a second position in which said spherical head frees the piston intake end, the insert being integral in traction with said hollow piston; the spherical head of the insert having a through passage which communicates with the discharge pressure of the pump and with a passage of the stud to supply fluid at the discharge pressure to said skew plate to hydrostatically balance said stud.

6. Hydraulic pump according to claim 5, wherein the part of the insert which slides inside the hollow piston has a groove within which moves a circlip integral with the piston to connect the insert in traction with the piston when said circlip abuts the adjacent wall of said groove.

7. Hydraulic pump according to claim 5, wherein the part of the insert which slides inside the piston has at least one passage permitting circulation of the fluid through the interior of the hollow piston.

8. A hydraulic pump comprising:

a piston driven in reciprocating motion between respective positions for fluid intake at one pressure and a fluid discharge at a higher pressure by a support stud riding against a skew plate rotated by a drive shaft, a non-return feed valve means at the end of the piston cooperating with the piston's support stud for supplying intake fluid to said piston and for reinjecting fluid at the discharge pressure to the interior of said stud which comprises;

the piston being hollow and having a spherical head with a through passage which spherical head rests with play in a spherical seating of its stud and which seating holds the spherical head while permitting it to move relative to said stud between a first position in which it bears against the bottom of its seating and a second position in which it is detached from the seating bottom but connected with the stud.

9. Hydraulic pump according to claim 8, wherein the pump has a fluid inlet chamber, each stud having at least one inlet passage providing communication between the seating and the inlet chamber, the skew plate moving the spherical head the first position to block communication between said stud inlet passage and the seating and to establish communication in the second position.

10. Hydraulic pump according to claim 9, wherein the stud has a passage opening to the skew plate face and the through passage of the spherical head opens into the stud passage to set said stud passage permanently at the same pressure as the discharge pressure.

11. A hydraulic pump comprising:

a hollow piston driven in reciprocating motion between respective positions for fluid intake at one pressure and a fluid discharge at a higher pressure by a support stud riding against a skew plate rotated by a drive shaft, a non-return feed valve means at the end of the piston cooperating with the piston's support stud for supplying intake fluid to said piston and for reinjecting fluid at the discharge pressure to the interior of said stud which comprises said piston being hollow and open at each end, the cylinder stud-side end having a part of enlarged inside diameter in which is located the spherical head of a stud, said stud spherical head movable between two positions: a first position in which it bears against the edge of the part of the piston whose diameter is not enlarged and a second position detached from said edge of the piston, and means cooperating between said piston enlarged diameter part and said stud spherical head for connecting said stud in traction with the piston.

12. Hydraulic pump according to claim 11, wherein said enlarged diameter part of the hollow piston is located has at least one passage to said edge such that when the spherical head is in its first position, the communication between said enlarged part at least one passage and the interior of the piston at said edge is interrupted and it is restored when the spherical head of the stud is in its second position.

13. Hydraulic pump according to claim 12, wherein the stud has a pedestal facing the skew plate with a chamber open to the face of the skew plate and said stud has a through passage to place said stud chamber in communication with the discharge pressure.

14. A hydraulic pump comprising:

a piston driven in reciprocating motion between respective positions for fluid intake at one pressure and a fluid discharge at a higher pressure by a support stud riding against a skew plate rotated by a drive shaft, a non-return feed valve means at the end of the piston opposite from the piston's support stud for supplying intake fluid to said piston and for reinjecting fluid at the discharge pressure to the interior of said stud, wherein the pump has an inlet chamber and the piston has on one end a spherical head which rests in a spherical seating of the stud with which it is connected and on the other end a non-return valve which is brought into communication by an annular groove on the piston wall intermediate the length of the piston with a pump central feed chamber in the pump body which communicates with the inlet chamber.

15. Hydraulic pump according to claim 14, wherein the stud has a passage opening to the skew plate face and the piston has a through channel bringing the bore within which the piston moves into communication with the passage of the stud.

16. Hydraulic pump according to claim 15, wherein the non-return valve disposed at the end of the piston includes a plurality of parallel passages which brings the piston annular groove into communication with said bore, and a circular plate of a circular valve for closing the entrance of each of said plurality of parallel passages.

17. Hydraulic pump according to claim 15, wherein the non-return valve at the end of the piston comprises a movable cylindrical ring which moves in a cage between two positions in which it opens or closes the communication between the piston annular groove and the interior of the cage.

18. Hydraulic pump according to claim 17, wherein the non-return valve is disposed inside a part of the piston which is hollow.

19. Hydraulic pump according to claim 18, wherein the piston has a spherical head which rests in a spherical seating in the stud with which it is integral in traction and an internal passage along its length, said spherical head having a channel communicating with said piston internal passage which brings the discharge pressure to the interior of the sliding stud.

20. Pump according to claim 19, wherein the piston, has openings at the end of its internal passage to bring said internal passage into communication with the pump inlet chamber.

21. Pump according to claim 20, wherein said piston openings are opened or closed by a valve formed by a ring which moves between a position where it abuts against the end of said internal passage to close said openings and another resting against a stop in the piston and said openings are open.

22. Pump according to claim 20, wherein said piston openings are opened or closed by a valve formed by a ring which moves between a closed position where it abuts against the end of said internal passage and an open position where it is freed therefrom; a spring which biases said ring toward the closed position, and means disabling the biasing action of said spring on said ring at a predetermined distance from the ring closed position.

23. Pump according to claim 21, wherein the predetermined distance is of the order of 0.10 to 0.15 mm.

24. Pump according to claim 22, wherein the spring acts on the ring through a first shoulder on the ring and is disabled from acting on the ring by a second shoulder, the offset between the first and second shoulders having a predetermined distance.

25. Pump according to claim 24 wherein the predetermined distance is of the order of 0.10 to 0.15 mm.

26. A hydraulic pump according to claim 14, wherein the piston is hollow with a through channel through which the pump fluid passes in communication with the bore within which the piston moves.

* * * * *